US012331611B2

(12) United States Patent
Goodeyon

(10) Patent No.: US 12,331,611 B2
(45) Date of Patent: Jun. 17, 2025

(54) APPARATUS, SYSTEMS AND METHODS TO ENERGIZE SEALS IN A ROD PUMP STUFFING BOX

(71) Applicant: Joe Goodeyon, Lenora, KS (US)

(72) Inventor: Joe Goodeyon, Lenora, KS (US)

( * ) Notice: Subject to any disclaimer, the term of this patent is extended or adjusted under 35 U.S.C. 154(b) by 0 days.

(21) Appl. No.: 18/536,909

(22) Filed: Dec. 12, 2023

(65) Prior Publication Data

US 2024/0191590 A1 Jun. 13, 2024

Related U.S. Application Data

(60) Provisional application No. 63/432,273, filed on Dec. 13, 2022.

(51) Int. Cl.
*E21B 33/08* (2006.01)
*E21B 47/06* (2012.01)

(52) U.S. Cl.
CPC ..... *E21B 33/08* (2013.01); *E21B 47/06* (2013.01)

(58) Field of Classification Search
CPC ..... E21B 33/08
See application file for complete search history.

(56) References Cited

U.S. PATENT DOCUMENTS 3,375,013 A * 3/1968 Grantom ..... E21B 33/08 277/330
3,827,487 A * 8/1974 Jackson ..... E21B 33/072 166/77.3
5,251,869 A * 10/1993 Mason ..... E21B 33/085 251/1.2
5,636,688 A * 6/1997 Bassinger ..... F04B 53/164 277/516
6,484,808 B2 * 11/2002 Jones ..... E21B 33/076 166/387
7,044,217 B2 * 5/2006 Hult ..... E21B 33/04 166/84.5
2009/0272521 A1 * 11/2009 Pecorari ..... E21B 33/085 166/84.2

* cited by examiner

*Primary Examiner* — Kenneth L Thompson
(74) *Attorney, Agent, or Firm* — Werner IP Law P.C.

(57) ABSTRACT

A system for compressing seals stacks in a stuffing box including a cylindrical housing, annular seal rings, an expanding bellows assembly, and a port in open communication with a source of fluid and with the expanding bellows assembly. Pumping fluid into the port causes expansion of said bellows assembly and compression of the seal rings.

17 Claims, 3 Drawing Sheets

APPARATUS, SYSTEMS AND METHODS TO ENERGIZE SEALS IN A ROD PUMP STUFFING BOX

CROSS REFERENCE TO RELATED APPLICATION

This application claims priority to U.S. Application No. 63/432,273 filed on Dec. 13, 2022, the disclosure of which is incorporated herein by reference for all purposes.

FIELD OF THE INVENTION

The present invention relates to preventing fluid or gas transmission from oil and gas wells. In particular, the present invention relates to an automated system for compressing the seals in a stuffing box to prevent leakage.

BACKGROUND OF THE INVENTION

Oil and gas wells produce a fluid combination comprising oil, gas, water, and solids in various concentrations. When natural flow can no longer lift these fluids from the well, various methods are used to artificially lift the fluids from the well. A very common system for this is a beam pump which is physically attached to a travelling valve pump deep in the well via a string of solid rods.

At the surface, the solid rods pass through a stuffing box that is designed to act as a pressure barrier between the fluids being lifted and the environment. A special rod with a very smooth and even surface, known as a polished rod, passes through a the stuffing box and elastomer seals inside the stuffing box provide the sealing element between the stuffing box housing and the polished rod.

The stuffing box design is prone to leakage due to seal failure. Seal failure can have a number of causes, including incorrect adjustment and wear.

The current method of adjusting the seals is to compress multiple seals in a stack. This is achieved by either turning a threaded cap to act on a follower to compress the seals or tightening a sequence of retaining bolts to act on a follower and compress the seals. This is a manual process that must be performed by an operator on a regular basis. The timing and amount of the adjustment is left to the individual operator's skill and knowledge. If the operator is incorrect in determining the amount of compression or when it should be applied, or the seals are worn beyond effective utility, the seals will fail, causing hydrocarbons to leak into the environment.

SUMMARY OF THE INVENTION

In one aspect, the present invention relates to an apparatus and method for compressing seals in a stuffing box.

In another aspect, the present inventions relates to an automatic apparatus and method for compressing seals in a stuffing box.

DETAILED DESCRIPTION OF PREFERRED EMBODIMENTS

Figure 1:
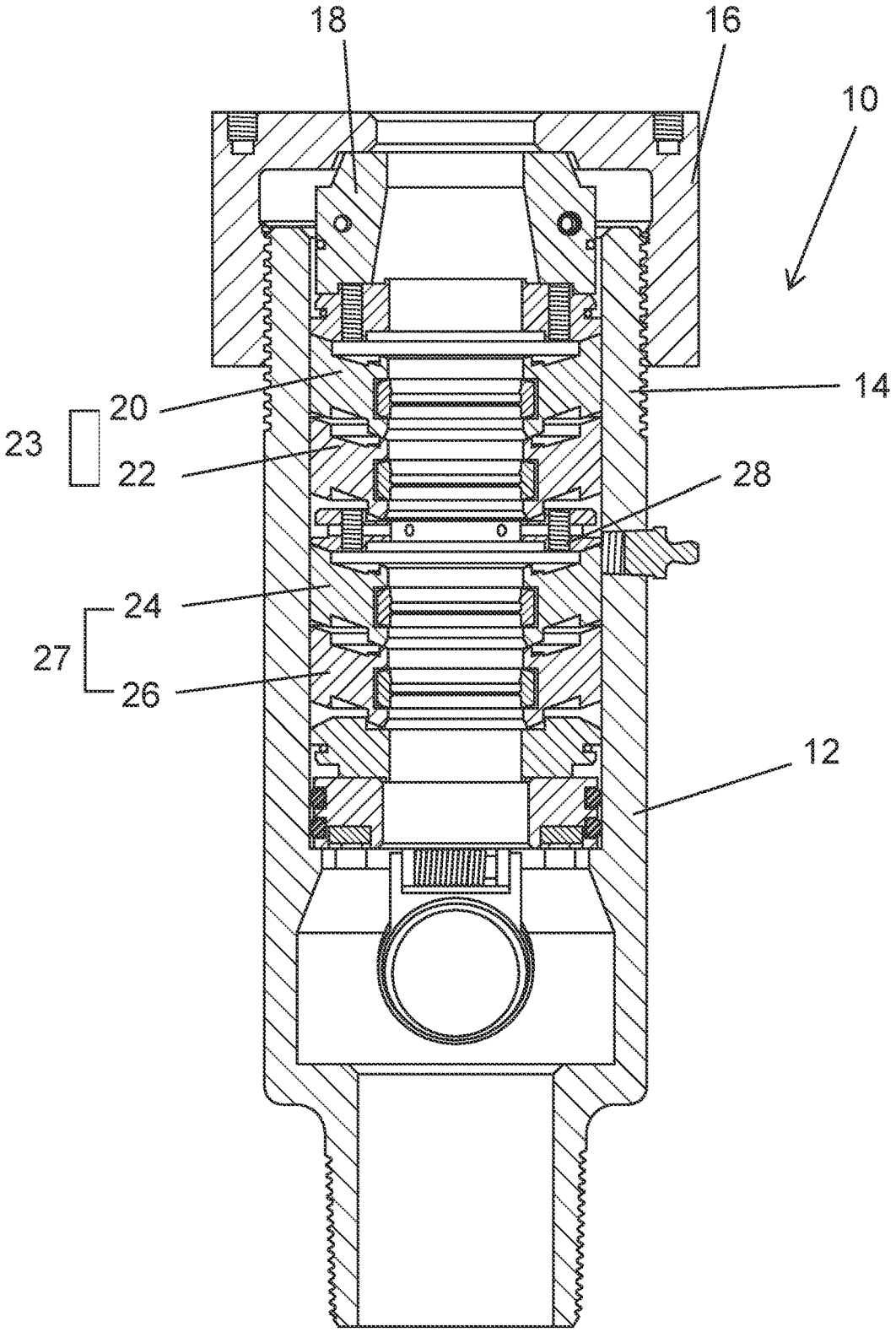
FIG. 1 PRIOR ART
FIG. 1 depicts a prior art stuffing box assembly.

Embodiments of the invention are described more fully hereafter with reference to the accompanying drawings. Elements that are identified using the same or similar reference characters refer to the same or similar elements which perform the same functions across various embodiments. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

FIG. 1 depicts an example of a prior art stuffing box assembly 10. Stuffing box 10 is generally formed from cylindrical housing 12. The upper end of cylindrical housing 12 includes a threaded section 14 on which is disposed threaded cap 16. Follower 18 is positioned below cap 16 and extends at least partially into housing 12. Elastomeric seals 20 and 22 form an upper seal stack 23. Elastomeric seals 24 and 26 form a lower seal stack 27. Grease ring (or lantern ring) 28 is positioned between upper and lower seal stacks 23 and 27, respectively.

Figure 2:
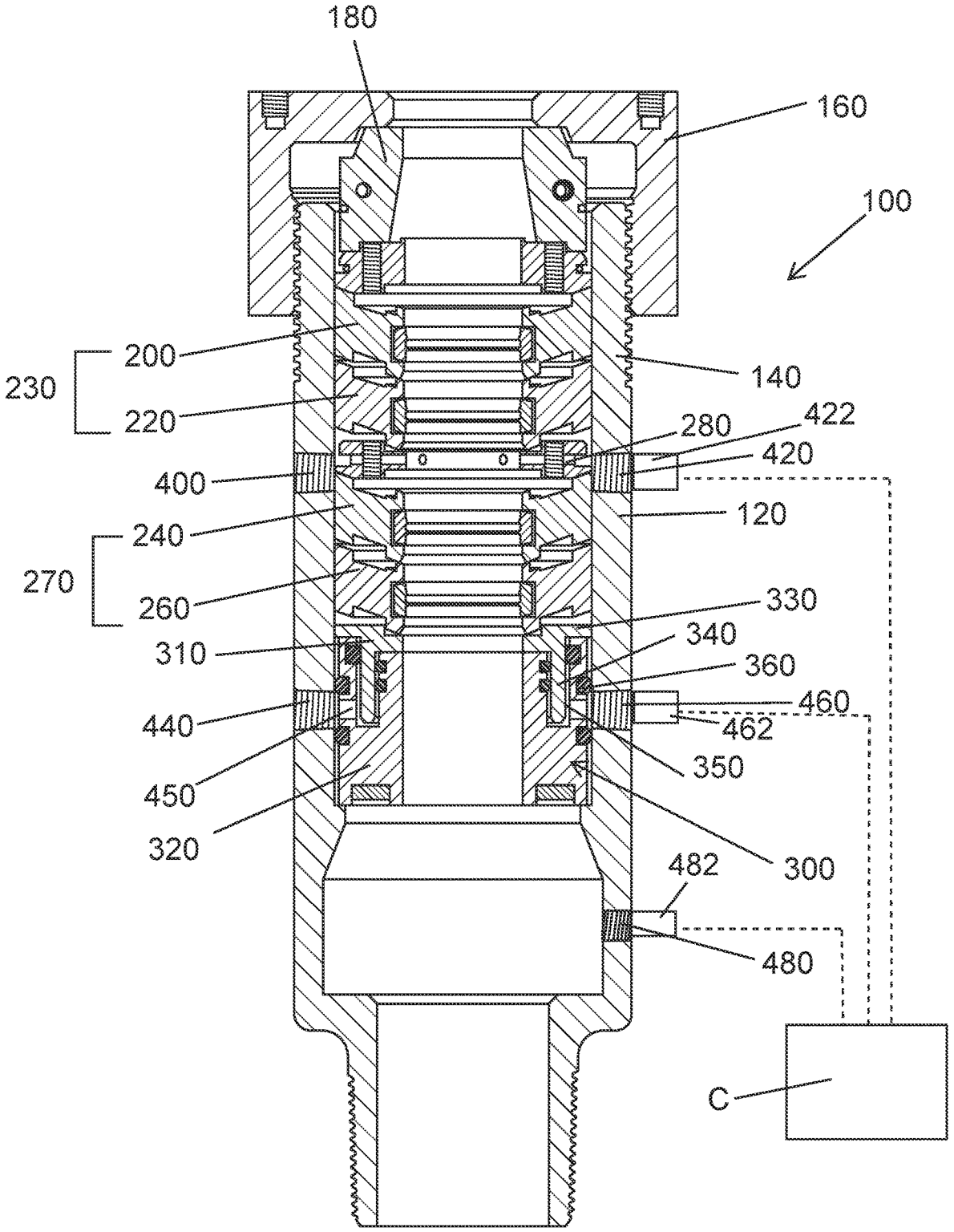
FIG. 2 depicts one embodiment of the seal compression system of the present invention.

FIG. 2 depicts one embodiment of a stuffing box assembly 100 of the present invention. Stuffing box 100 is generally formed from cylindrical housing 120. The upper end of cylindrical housing 120 includes a threaded section 140 on which is disposed threaded cap 160. Follower 180 is positioned below cap 160 and extends at least partially into housing 120. It will be appreciated that threaded cap and follower are optional features. It may be desired to use the traditional means for compressing seals in addition to the expanded bellows system of the present invention. Elastomeric seals 200 and 220 form an upper seal stack 230. Elastomeric seals 240 and 260 form a lower seal stack 270. Grease ring (or lantern ring) 280 is positioned between upper and lower seal stacks 230 and 270, respectively.

Expanding bellows assembly 300 is positioned below lower seal stack 270. Bellows 300 includes upper ring 310 and lower ring 320. Upper ring 310 is formed from flange 330 and annular sleeve 340. Lower ring 320 includes a groove 350 in which is received sleeve 340. A plurality of seals 360 ensure that the pressurizing media (discussed more below) does not leak from bellows 300. It will be appreciated that the reference to "upper" and "lower" is with respect to the positions shown in the drawings and is not intended to be limiting. Accordingly, bellows 300 could be installed such that ring 310 is below ring 320.

A plurality of ports are formed in housing 120. Port 400 allows for lubricating fluid/grease to be pumped into grease ring 280 from a grease source (not shown). The grease helps lubricate the solid rod as it moves through the stuffing box. Port 420 allows for the installation of a pressure sensor 422 to measure the pressure of the grease. This pressure sensor can be used to detect leaks in the seal rings, should the pressure change unexpectedly.

Port 440 is in open engagement with a space 450 formed between upper and lower rings 310 and 320, respectively. Pressurizing media from a source (not shown) can be pumped into cavity 450 thereby forcing upper ring 310 to move away from lower ring 320 and in turn, compressing upper and lower seal stacks 230 and 270, respectively. Port 460 is in open communication with cavity 450. A pressure sensor 462 can be installed at port 460 to measure the pressure of the pressurizing media. Bellows 300 can be expanded using hydraulic fluid, grease, air, or any other suitable pressurizing media. The pressure sensor at port 460 allows operators to monitor the performance of the bellows. If the pressure indicated by the pressure sensor drops, it could indicate a leak in either the bellows or one or more of the seal stacks. As shown in FIG. 2, there is also a port 480 which allows for the installation of a pressure sensor 482 to measure the flowing tubing pressure in the system.

In a preferred embodiment, the system includes one or more controllers C operatively connected to the grease pumping system, fluid pumping system, and pressure sensors 422, 462, and 482 installed at ports 420, 460, and 480, respectively. The controller C can initiate compression of the seal stacks by controlling the injection of the pressurized media. The controller C can also track the pressures sensed at ports 420 and 480. If the pressures measured at the two respective ports are similar, then seal compression is to be initiated. It will be appreciated that instead of the bellows assembly 300 in FIG. 2, an annular piston could be employed. In that case, pressurizing media pumped into the assembly below the piston would cause the piston to rise and compress the seal stacks.

Figure 3:
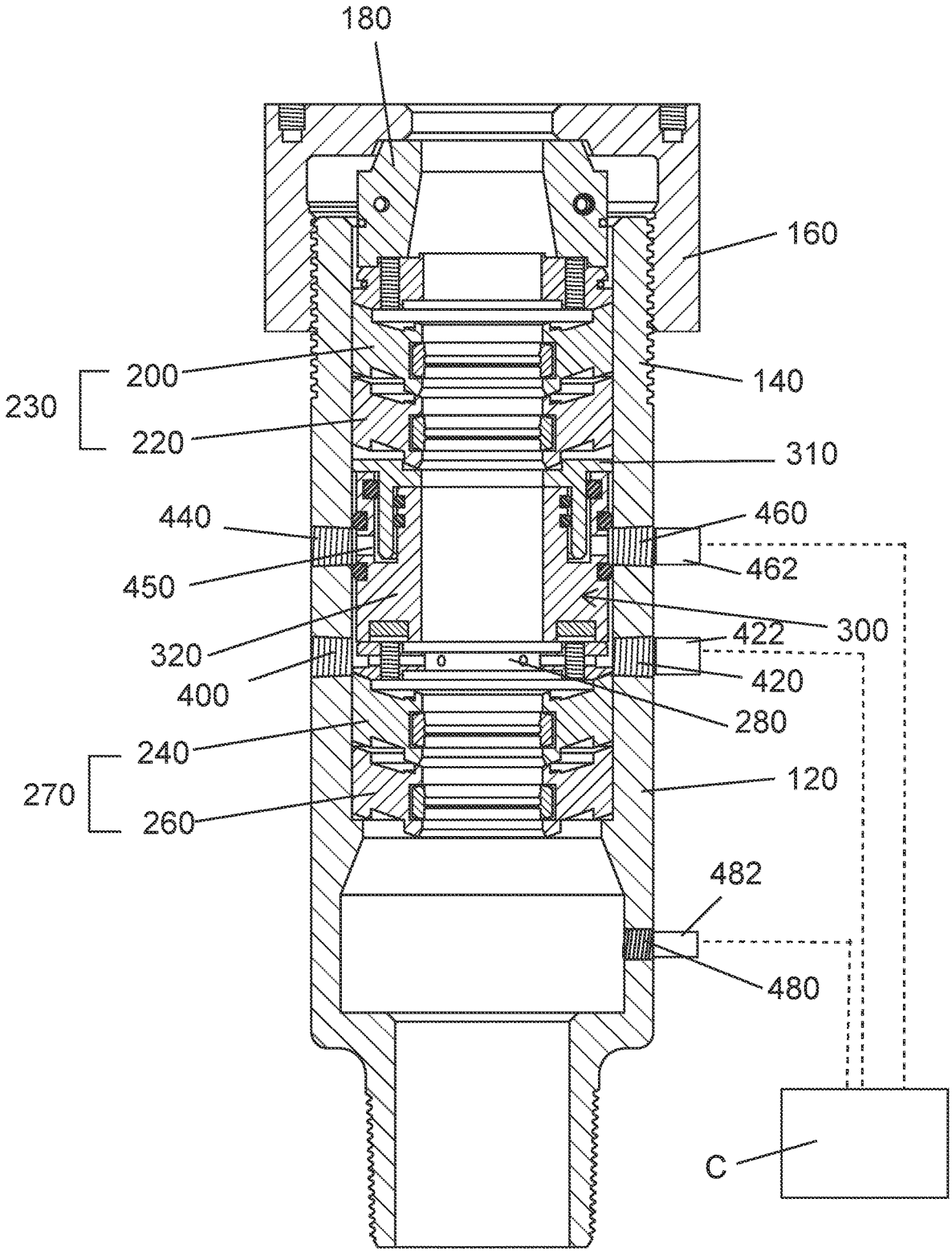
FIG. 3 depicts another embodiment of the seal compression system of the present invention.

The embodiment shown in FIG. 3 is similar to that of FIG. 2, but the bellows 300 is positioned between upper and lower seal stacks 230 and 270, respectively. In this embodiment, the pumping of pressurizing media into space 450 causes the upper ring 310 and lower ring 320 to both move away from each other, thereby causing compression of the respective seal stacks.

It will be appreciated by those skilled in the art that the exact number and configuration of seals, seal stacks, and grease rings described in the embodiments above can vary based on the needs of the particular stuffing box. It will also be appreciated that all of the various components are annular in design, thus producing a substantially cylindrical opening through the assembly to accommodate a solid rod, e.g., a polished rod, which will move up and down through the stuffing box assembly. Other components well known to those skilled in the art which are typically present in stuffing box assemblies have not been described in detail herein, but will be understood to be present.

The present invention provides several advantages over the prior art. The compression of the seal stacks using the expanding bellows eliminates the need for manual adjustment by operators. This saves time and improves the safety of the system. The use of pressure sensors allows for real time monitoring of the pressure. The system can be programmed to send notices/alerts should the pressure drop below a predetermined amount. This allows for the quick identification of a weak/broken seal and prevents leaking.

Although specific embodiments of the invention have been described herein in some detail, this has been done solely for the purposes of explaining the various aspects of the invention and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A system for compressing seals stacks in a stuffing box, comprising:

a cylindrical housing;

at least one annular seal ring;

an expanding bellows assembly positioned above or below said at least one annular seal ring;

a port in open communication with a source of fluid and with said expanding bellows assembly;

whereby pumping fluid into said port causes expansion of said bellows assembly and compression of said at least one annular seal ring;

a first pressure sensor operative to measure flowing tubing pressure of said system;

a grease ring disposed in said housing; and a second pressure sensor operative to measure pressure at said grease ring.

2. The system of claim 1, comprising a plurality of annular seal rings and wherein the expanding bellows assembly is positioned below all of said annular seal rings.

3. The system of claim 1, wherein said expanding bellows comprises a first bellows ring, a second bellows ring, and an annular cavity between said first and second bellows rings.

4. The system of claim 3, wherein said port is in open communication with said annular cavity.

5. The system of claim 3, wherein said first bellows ring has a flange and a sleeve, and said second bellows ring has an annular groove sized for receiving said sleeve of said first bellows ring.

6. The system of claim 3, further comprising a third pressure sensor operatively connected to said annular cavity to measure pressure therein.

7. The system of claim 6, further comprising a controller operative to monitor the pressure measured by said third pressure sensor.

8. The system of claim 1, further comprising a controller operative to monitor the pressures measured by said first and second pressure sensors.

9. A system for compressing seals stacks in a stuffing box, comprising:

a cylindrical housing;

a plurality of annular seal rings;

an expanding bellows assembly positioned between said annular seal rings;

a port in open communication with a source of fluid and with said expanding bellows assembly;

whereby pumping fluid into said port causes expansion of said bellows assembly and compression of said plurality of annular seal rings;

a first pressure sensor operative to measure flowing tubing pressure of said system;

a grease ring disposed in said housing; and a second pressure sensor operative to measure pressure at said grease ring.

10. The system of claim 9, wherein said expanding bellows comprises a first bellows ring, a second bellows ring, and an annular space between said first and second bellows rings.

11. The system of claim 10, wherein said port is in open communication with said annular space.

12. The system of claim 10, wherein said first bellows ring has a flange and a sleeve, and said second bellows ring has an annular groove sized for receiving said sleeve of said first bellows ring.

13. The system of claim 10, further comprising a third pressure sensor operatively connected to said annular space to measure pressure therein.

14. The system of claim 13, further comprising a controller operative to monitor the pressure measured by said third pressure sensor.

15. The system of claim 9, further comprising a controller operative to monitor the pressures measured by said first and second pressure sensors.

16. A method of compressing seals stacks in a stuffing box, comprising:

providing a stuffing box assembly comprising:

a cylindrical housing;

at least one annular seal ring;

an expanding bellows assembly positioned adjacent said at least one annular seal ring; and a port in open communication with a source of fluid and with said expanding bellows assembly;

a first pressure sensor operative to measure flowing tubing pressure of said system;

a grease ring disposed in said housing; and a second pressure sensor operative to measure pressure at said grease ring;

pumping fluid into said port to cause the expansion of said bellows assembly and compression of said at least one annular seal ring.

17. The method of claim 16, wherein said stuffing box assembly comprises a plurality of annular seal rings and wherein said expanding bellows assembly is positioned between said annular seal rings.

* * * * *